US010106865B2

(12) United States Patent
Park et al.

(10) Patent No.: US 10,106,865 B2
(45) Date of Patent: Oct. 23, 2018

(54) STEEL SHEET AND MANUFACTURING METHOD THEREFOR

(71) Applicant: Hyundai Steel Company, Incheon (KR)

(72) Inventors: Jin-Sung Park, Asan-si (KR); Chun-Ku Kang, Dangjin-si (KR); Nam-Hoon Goo, Suwon-si (KR); Seong-Ju Kim, Yongin-si (KR)

(73) Assignee: Hyundai Steel Company, Dong-gu (KR)

( * ) Notice: Subject to any disclaimer, the term of this patent is extended or adjusted under 35 U.S.C. 154(b) by 551 days.

(21) Appl. No.: 14/780,513

(22) PCT Filed: Jan. 29, 2014

(86) PCT No.: PCT/KR2014/000847
§ 371 (c)(1),
(2) Date: Sep. 25, 2015

(87) PCT Pub. No.: WO2014/157823
PCT Pub. Date: Oct. 2, 2014

(65) Prior Publication Data

US 2016/0053340 A1 Feb. 25, 2016

(30) Foreign Application Priority Data

| | | |
|---|---|---|
| Mar. 28, 2013 | (KR) | 10-2013-0033942 |
| May 31, 2013 | (KR) | 10-2013-0062725 |
| Jun. 27, 2013 | (KR) | 10-2013-0074924 |
| Jan. 28, 2014 | (KR) | 10-2014-0010354 |

(51) Int. Cl.

| | |
|---|---|
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/18*** | (2006.01) |
| ***C22C 38/22*** | (2006.01) |
| ***C22C 38/34*** | (2006.01) |
| ***C22C 38/38*** | (2006.01) |
| ***C21D 6/00*** | (2006.01) |

(52) U.S. Cl.

CPC ..... *C21D 8/0263* (2013.01); *C21D 6/002* (2013.01); *C21D 6/005* (2013.01); *C21D 6/008* (2013.01); *C21D 8/0205* (2013.01); *C21D 8/0221* (2013.01); *C21D 8/0226* (2013.01); *C21D 8/0236* (2013.01); *C21D 8/0247* (2013.01); *C21D 9/46* (2013.01); *C22C 38/00* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/12* (2013.01); *C22C 38/18* (2013.01); *C22C 38/22* (2013.01); *C22C 38/34* (2013.01); *C22C 38/38* (2013.01); *C21D 8/02* (2013.01); *C21D 2211/005* (2013.01); *C21D 2211/008* (2013.01)

(58) Field of Classification Search

CPC ..... C21D 8/0263; C21D 6/008; C21D 6/002; C21D 6/005; C21D 8/0205; C21D 8/0226; C21D 8/0236

See application file for complete search history.

(56) References Cited

U.S. PATENT DOCUMENTS 5,555,756 A * 9/1996 Fischer ..... B21B 45/0263 72/41

FOREIGN PATENT DOCUMENTS

| | | | |
|---|---|---|---|
| CN | 101960038 | A | 1/2011 |
| CN | 102341521 | A | 2/2012 |
| CN | 102348823 | A | 2/2012 |
| EP | 1972698 | A1 | 9/2008 |
| EP | 2184374 | A1 | 5/2010 |
| JP | 2008-144233 | A | 6/2008 |
| JP | 2009-215572 | A | 9/2009 |
| JP | 2010-037652 | A | 2/2010 |
| KR | 950007472 | B1 | 7/1995 |
| KR | 2000-0016460 | A | 3/2000 |
| KR | 2003-0032437 | A | 4/2003 |
| KR | 20110110370 | A | 10/2011 |
| KR | 20120132834 | A | 12/2012 |
| WO | 2008082134 | A1 | 7/2008 |
| WO | WO-2013018741 | A1 | 2/2013 |

OTHER PUBLICATIONS

International Search Report for PCT/JP2014/000847 dated May 13, 2014.

Chinese Office Action dated May 3, 2016, and English translation thereof, issued during the prosecution of corresponding Chinese Patent Application No. 201480018826.9.

Extended European Search Report, of the European Patent Office, dated Jan. 2, 2017, in corresponding European Patent Application No. 14776303.1.

* cited by examiner

*Primary Examiner* — Jessee R Roe

(74) *Attorney, Agent, or Firm* — Locke Lord LLP; Daniel J. Fiorello

(57) ABSTRACT

Disclosed are a steel sheet having excellent and a method for producing the same. The disclosed steel sheet comprises, by weight, 0.005-0.06% carbon (C), 0.2% or less silicon (Si), 1.0-2.0% manganese (Mn), 0.01% or less sulfur (S), 0.2-2.0% aluminum (Al), one or more of chromium (Cr) and molybdenum (Mo) in an amount satisfying 0.3≤[Cr wt %]+0.3[Mo wt %]≤2.0, and 0.008% or less nitrogen (N), with the remainder being iron (Fe) and inevitable impurities, wherein the density of dislocations in the ferrite matrix of the steel sheet is $1\times10^{13}/m^2$ or more.

8 Claims, No Drawings

STEEL SHEET AND MANUFACTURING METHOD THEREFOR

CROSS-REFERENCE TO RELATED APPLICATIONS

This application is the national phase under 35 U.S.C. § 371 of PCT International Application No. PCT/KR2014/000847, filed Jan. 29, 2014, which claims benefit and priority of Korean Application No. 10-2013-0033942, filed Mar. 28, 2013; Korean Application No. 10-2013-0062725, filed May 31, 2013; Korean Application No. 10-2013-0074924,filed Jun. 27, 2013, and Korean Application No. 10-2014-0010354, filed Jan. 28, 2014; the entire contents of the aforementioned applications are hereby incorporated herein by reference.

TECHNICAL FIELD

The present invention relates to steel sheet production technology, and more particularly, to a steel sheet having excellent aging resistance, and a method for producing the same.

BACKGROUND ART

Exterior panels for motor vehicles are required to have low yield ratio properties in order to ensure shape fixability during forming processes. On the other hand, formed exterior panels in finished motor vehicles are required to have dent resistance so that they will not be easily deformed by external stress.

Bake-hardening steel is a kind of steel which can satisfy such both properties and in which solid solution carbon remains in the steel so that the yield strength of the final product can be increased by the diffusion of carbon to dislocations in a paint baking process to thereby ensure the dent resistance of the final product. Generally, bake-hardening steel guarantees an increase in yield strength of 3 $kgf/mm^2$ or more.

However, solid solution carbon has some activity even under room temperature conditions other than paint baking conditions, and causes an aging phenomenon and yield point elongation.

The aging phenomenon occurs because solid solution carbon diffuses to mobile dislocations to interfere with the migration of the dislocations. The aging phenomenon also increases in proportion to the amount of solid solution carbon, and a method of controlling the amount of solid solution carbon in steel to about 0.001 wt % has been widely used to inhibit the aging phenomenon. However, the amount of solid solution carbon in steel is changed due to the components of the steel and various process variables in the steel production process, and the steel is exposed to conditions in which the aging phenomenon can occur at any time depending on the storage temperature of the steel.

It has been generally known that bake-hardening steels have aging resistance for 3 months at room temperature. However, in fact, the bake-hardening steels are required to have aging resistance for a longer period of time (about 6-12 months) when taking into consideration the transportation period and the time point of use.

Prior art documents related to the present invention include Korean Patent Laid-Open Publication No. 10-2000-0016460 (published on Mar. 25, 2000), entitled "Coated seizure hardening type cold-rolled steel sheet and production method thereof".

DISCLOSURE

Technical Problem

It is an object of the present invention to provide a steel sheet having excellent aging resistance, and a method for producing the same.

Technical Solution

To achieve the above object, in accordance with an embodiment of the present invention, there is provided a steel sheet comprising, by weight, 0.005-0.06% carbon (C), 0.2% or less silicon (Si), 1.0-2.0% manganese (Mn), 0.01% or less sulfur (S), 0.2-2.0% aluminum (Al), one or more of chromium (Cr) and molybdenum (Mo) in an amount satisfying $0.3 \leq [Cr\ wt\ \%]+0.3[Mo\ wt\ \%] \leq 2.0$ wt %, and 0.008% or less nitrogen (N), with the remainder being iron (Fe) and inevitable impurities, wherein the density of dislocations in the ferrite matrix of the steel sheet is $1\times10^{13}/m^2$ or more.

Herein, the steel sheet may have a microstructure composed of 2.0-10.0 vol % martensite with the remainder being ferrite.

The steel sheet may further comprise 0.02-0.08 wt % phosphorus (P).

The [Cr wt %]+0.3[Mo wt %] is preferably 0.5-1.5 wt %.

The steel sheet preferably comprises 0.3-1.5 wt % chromium (Cr). In this case, the steel sheet may comprise one or more of 0.02-0.08 wt % phosphorus (P) and 0.05-0.4 wt % molybdenum (Mo).

The steel sheet preferably comprises 0.3-1.0 wt % aluminum (Al).

In accordance with another embodiment of the present invention, there is provided a method for producing a steel sheet, comprising the steps of: reheating a steel slab having the above-described alloy composition; hot-rolling the reheated steel slab at a temperature equal to or higher than the Ar3 point to obtain a hot-rolled steel sheet; coiling the hot-rolled steel sheet at a temperature of 680° C. or higher; pickling the coiled steel sheet, followed by cold rolling; annealing the cold-rolled steel sheet such that the austenite volume fraction thereof is 20 vol % or less, followed by cooling; and temper-rolling the cooled steel sheet.

In the method, the annealing is preferably performed such that the austenite volume fraction is 10-20 vol %.

The cooling may be performed to a temperature ranging from 450° C. to 510° C. In this case, the method may further comprise the steps of: isothermally transforming the cooled steel sheet; and cooling the isothermally transformed steel sheet to a temperature equal to or lower than the Ms point, and the temper rolling may be performed on the steel sheet cooled to a temperature equal to or lower than the Ms point.

The cooling may be performed to a temperature equal to or lower than the Ms point.

In addition, the cooling may be performed at an average cooling rate of 15-30° C./sec.

In addition, the method may further comprise, between the annealing and cooling step and the temper-rolling step, a step of hot-dipping the steel sheet.

The temper rolling is preferably performed at a reduction ratio of 0.5-2.0%.

Advantageous Effects

According to the steel sheet production method of the present invention, alloying components such as carbon, aluminum and chromium are controlled while processes such as coiling, annealing and cooling processes are controlled. As a result, the steel sheet can show a dislocation density of $1\times10^{13}/m^2$ or more in the ferrite matrix together with a two-phase structure of ferrite and martensite, and thus can show an r-value of 1.2 or more, a bake hardenability of 30 MPa or higher, and aging resistance for 6 months or more.

Thus, the steel sheet according to the present invention is particularly suitable for use as an exterior panel for a motor vehicle.

MODE FOR INVENTION

Hereinafter, a steel sheet according to an embodiment of the present invention and a production method thereof will be described in detail.

Steel Sheet

The steel sheet according to the present invention contains, by weight, 0.005-0.06% carbon (C), 0.2% or less silicon (Si), 1.0-2.0% manganese (Mn), 0.01% or less sulfur (S), 0.2-2.0% aluminum (Al), one or more of chromium (Cr) and molybdenum (Mo) in an amount satisfying 0.3≤[Cr wt %]+0.3[Mo wt %]≤2.0 wt %, and 0.008% or less nitrogen (N).

In addition, the steel sheet may further comprise 0.02-0.08 wt % phosphorus (P).

The steel sheet contains the above-described alloying components with the remainder being iron (Fe) and impurities that are inevitably included during the steel production process and the like.

The functions and contents of components contained in the steel sheet of the present invention will now be described.

Carbon (C)

The martensite structure is a structure containing the supersaturated carbon by diffusionless transformation from the austenite structure, and carbon contributes to the formation of this martensite structure.

Carbon is preferably contained in an amount of 0.005-0.06 wt % based on the total weight of the steel sheet. For the purpose of achieving an elongation of 38% or more, carbon is preferably contained in an amount of 0.005-0.025 wt %. In this carbon content range, the martensite structure can be obtained without greatly reducing the elongation of the steel sheet, and aging resistance can also be ensured by this martensite structure. If the carbon content is less than 0.005 wt %, it will be difficult to form the martensite structure. On the contrary, if the carbon content is more than 0.06 wt %, the strength of the steel sheet will excessively increase and the elongation will decrease, resulting in a decrease in the formability of the steel sheet.

Silicon (Si)

Silicon (Si) is added as a deoxidizing agent to remove oxygen from steel in the steel making process. In addition, silicon contributes to the improvement in strength of the steel sheet by solid solution strengthening.

Silicon is preferably contained in an amount of 0.2 wt % or less, more preferably 0.1 wt % or less, based on the total weight of the steel sheet. If the content of silicon is more than 0.2 wt %, there will be a problem in that a large amount of oxide is formed on the steel sheet surface to reduce the processability of the steel sheet.

Manganese (Mn)

Manganese is an effective hardening element, and contributes to the formation of martensite during cooling after annealing.

Manganese is preferably contained in an amount of 1.02.0 wt % based on the total weight of the steel sheet. If the content of manganese is less than 1.0 wt %, the effect of manganese added will be insufficient. On the contrary, if the content of manganese is more than 2.0 wt %, the phase transformation temperature of the steel sheet will decrease, and a phase change will be caused by recrystallization before development of the <111>/ND texture, resulting in a decrease in formability, and surface oxidation of manganese can also cause surface quality problems.

Sulfur (S)

Sulfur (S) can form MnS to reduce the effective manganese content and to cause surface defects by MnS.

For this reason, in the present invention, the content of sulfur is limited to 0.01 wt % or less based on the total weight of the steel sheet.

Aluminum (Al)

Aluminum (Al) that is used in the present invention is an element that serves as a deoxidizing agent. Particularly, it is an element that can delay the Ac3 transformation to thereby increase the concentration of carbon in austenite. In addition, it is an element effective in making a hard austenite phase even with a low carbon content of 0.06 wt % or less in the cooling process following annealing.

Aluminum is preferably contained in an amount of 0.2-2.0 wt %, more preferably 0.3-1.0 wt %, based on the total weight of the steel sheet. If the content of aluminum is less than 0.2 wt %, the fraction of austenite will increase rapidly in the two-phase temperature range during annealing to increase variation in the quality of the steel sheet, and the concentration of carbon in austenite will also decrease, and thus carbide structures such as bainite or pearlite will be formed during cooling, resulting in an increase in yield strength, a decrease in aging resistance and a decrease in the hardness of martensite. On the contrary, if the content of aluminum is more than 2.0 wt %, the Ac3 temperature will increase, and thus the two-phase fraction will decrease during annealing, and ultimately the production of martensite will be inhibited. In addition, in this case, there will be problems in that inclusions increase, surface oxidation occurs during annealing, and plating quality is reduced.

Chromium (Cr) and Molybdenum (Mo)

Chromium (Cr) and molybdenum (Mo) are elements that can enhance the hardenability of the steel sheet to obtain a martensite structure. However, if the content of chromium is excessively high, the fraction of austenite will increase rapidly during annealing to reduce the concentration of carbon. In addition, if the content of molybdenum is excessively high, the Ac3 temperature will increase to reduce the fraction of austenite, and the increase in the Ac3 temperature causes a decrease in productivity in a general continuous annealing line. Furthermore, the change in effects caused by the contents of chromium and molybdenum is remarkable in the case of chromium.

Based on this fact, the present inventors have conducted studies over a long period of time, and as a result, have found that, when chromium and molybdenum in the alloy composition of the steel sheet according to the present invention satisfy the following condition, they contribute to obtaining a martensite structure without causing problems by the excessive contents of chromium and molybdenum:

$$0.3\leq[\text{Cr wt }\%]+0.3[\text{Mo wt }\%]\leq2.0\text{ wt }\%.$$

If [Cr wt %]+0.3[Mo wt %] is less than 0.3 wt %, chromium and molybdenum will not exhibit a sufficient effect on improvement in the hardenability of the steel sheet. On the contrary, if [Cr wt %]+0.3[Mo wt %] is more than 2.0 wt %, the problem caused by the excessive addition of chromium or molybdenum can occur. More preferably, [Cr wt %]+0.3[Mo wt %] is 0.5≤[Cr wt %]+0.3[Mo wt %]≤1.5 wt % in terms of securely obtaining martensite.

Meanwhile, chromium is more preferably contained in an amount of 0.3-1.5 wt % based on the total weight of the steel sheet. In this case, the steel sheet according to the present invention may contain one or more of 0.02-0.08 wt % phosphorus (P) and 0.05-0.4 wt % molybdenum (Mo).

Nitrogen (N)

Nitrogen (N) causes inclusions in steel to reduce the internal quality of the steel sheet.

For this reason, in the present invention, the content of nitrogen is limited to 0.008 wt % or less based on the total weight of the steel sheet.

Phosphorus (P)

Phosphorus (P) partially contributes to an increase in strength, and can exhibit the effect of improving the texture of the steel sheet. This effect is more significant when the content of phosphorus in the steel sheet is 0.02 wt % or more. Phosphorus is particularly effective in controlling the r-value in the 45° direction. However, if phosphorus is excessively contained in an amount of more than 0.08 wt % based on the total weight of the steel sheet, it can cause surface defects by segregation, as well as brittleness problems.

For this reason, when phosphorus is intentionally added, the content of phosphorus is preferably 0.02-0.08 wt % based on the total weight of the steel sheet.

Meanwhile, in the case of the steel sheet according to the present invention, niobium and titanium are carbonitride-forming elements, and when these elements are excessively added, these increase the yield strength of the steel sheet and also reduce the content of solid solution carbon to interfere with the formation of martensite. Thus, these elements are preferably not added, and when these elements are contained in the steel sheet, the content of each of these elements is preferably limited to less than 1 wt %.

As a result of controlling the alloying components as described and the processes as described below, the steel sheet according to the present invention has a characteristic in that the density of dislocations in the ferrite matrix is $1\times10^{13}/m^2$ or more, and more preferably $1\times10^{13}/m^2$ to $9.9\times10^{13}/m^2$. If the density of dislocations in the ferrite matrix is less than $1\times10^{13}/m^2$, the aging resistance of the steel sheet can be reduced, because the dislocation density is insufficient.

The steel sheet according to the present invention may be composed of 2.0-10.0 vol % with the remainder being substantially ferrite. More specifically, the martensite can show hulled millet-shaped grains having an average grain size of 5 μm or less. The ferrite structure may be composed of a polygonal ferrite.

Thanks to the dislocation density and microstructure as described above, the steel sheet according to the present invention can show an r-value of 1.2 or higher, a bake hardenability of 30 MPa or higher, and aging resistance for 6 months or more.

Method for Production of Steel Sheet

A method for producing the steel sheet according to the present invention comprises a slab reheating step, a hot-rolling step, a coiling step, a cold-rolling step, an annealing step, a cooling step and a temper-rolling step.

In the slab reheating step, a steel slab having the above-described alloy composition is reheated to a temperature ranging from about 1100° C. to about 1300° C.

Next, in the hot-rolling step, the reheated steel slab is hot-rolled at a temperature equal to or higher than the Ar3 point to obtain a hot-rolled steel sheet.

Next, in the coiling step, the hot-rolled steel sheet is cooled, and then coiled. Herein, the coiling temperature is preferably 680° C. or higher, and more preferably 680 to 750° C. If the coiling temperature is lower than 680° C., second-phase carbides such as pearlite or cementite will be produced to cause a shear band that deteriorates the texture of the steel sheet during cold rolling, and austenite having high carbon concentration will be produced in the carbide texture, and thus the elongation of the steel sheet will decrease while the strength of the steel sheet will increase rapidly. For these reasons, the coiling is performed at a temperature of 680° C. or higher to control the hot-rolled structure to a polygonal ferrite.

Next, in the cold-rolling step, the coiled steel sheet is pickled, and then cold-rolled at a reduction ratio of about 50-80%.

Next, in the annealing step, the cold-rolled steel sheet is annealed to control the fraction of austenite in order to control the microstructure of the resulting steel sheet.

Herein, the annealing is preferably performed under the time and temperature conditions in which the austenite fraction becomes 20 vol % or lower, more preferably 10-20 vol %. In this austenite fraction range, the two-phase structure (martensite) of the steel can be developed in an amount of 2% or more after cooling, and the mobile dislocation density of the steel can be increased during annealing and temper rolling, thereby increasing the age resistance of the steel. If the austenite fraction is less than 10 vol %, it will be difficult to obtain 2% or more martensite. On the contrary, if the austenite fraction is more than 20%, the r-value cannot reach 1.2 due to the excessive production of martensite. In order to achieve this austenite fraction, the annealing is preferably performed at a temperature ranging from 810° C. to 850° C. for about 60 seconds. More preferably, the annealing is performed at a temperature ranging from 820° C. to 840° C.

In the cooling step, the annealed steel sheet is cooled in order to obtain a desired microstructure. Herein, the cooling is preferably performed at an average cooling rate of 15-30'C/sec. When the average cooling rate is 15° C./sec or higher, martensite can be produced during cooling, and thus the dislocation density can increase during the phase-change process. However, if the average cooling rate is higher than 30° C./sec, there will be a problem in that the dislocation density excessively increases, resulting in an excessive increase in the yield ratio.

As one example, the cooling may be performed to a temperature ranging from 450° C. to 510° C. In this case, the method may further comprise, after the cooling step, a step of isothermally transforming the steel sheet and cooling the isothermally transformed steel sheet to a temperature equal to or lower than the Ms point. The isothermal transformation process can control the strength and elongation of the steel sheet.

As another example, the cooling may be performed to a temperature equal to or lower than the Ms point. In this case, the isothermal transformation process may further be performed.

In the temper-rolling step, the cooled steel sheet is temper-rolled by a skin pass mill (SPM) to increase the dislocation density of the steel sheet.

The temper rolling is preferably performed at a reduction ratio of 0.5-2.0%. If the reduction ratio in the temper rolling is lower than 0.5%, the effect of increasing the dislocation density of the steel sheet will be insufficient. On the contrary, if the reduction ratio in the temper rolling is higher than 2.0%, the yield strength of the steel sheet can increase to cause a decrease in shape fixability.

Meanwhile, the method may further comprise, between the annealing and cooling step and the temper-rolling step, a step of hot-dipping the steel sheet.

The hot dipping may be performed either by hot-dip galvanizing at a temperature ranging from about 450° C. to about 510° C., or by hot-dip galvanizing at a temperature ranging from about 450° C. to about 510° C., followed by alloying heat treatment at a temperature ranging from about 500° C. to about 550° C.

In the present invention, the temperature of the coiling process after hot rolling was controlled to 680° C. or higher, and thus the volume ratio of coarse carbides larger than 1 μm or pearlite was controlled to 10% or less, whereby the development of shear textures during annealing after cold rolling was reduced, thereby developing [111]<110> γ-fiber. When the hot-rolled material produced as described above was cold-rolled and annealed, the γ volume ratio of the two phases was controlled to 20% or less, and thus the formation of transformed ferrite during cooling after annealing was inhibited, thereby preventing a decrease in the development of γ-fiber.

As described above, in the present invention, solid solution carbon remains in steel so that the density of mobile dislocations in the ferrite matrix structure of the steel having a bake-hardening property will be sufficiently ensured, thereby inhibiting the room temperature aging phenomenon. Ensuring the dislocation density is performed in the annealing step and the subsequent temper-rolling step. More specifically, in the annealing step, the increase in density of dislocations by the production of a martensite structure having a great difference in hardness from ferrite is used, and in the temper rolling step, the increase in density of dislocations by the difference in hardness between the martensite structure and the ferrite phase is used. Because the room temperature aging phenomenon and yield point elongation are caused by interactions between carbon and mobile dislocations in ferrite, aging resistance can be ensured when the density of mobile dislocations is sufficiently ensured.

EXAMPLES

Hereinafter, the construction and effects of the present invention will be described in further detail with reference to preferred examples. It is to be understood, however, that these examples are for illustrative purposes only and are not intended to limit the scope of the present invention in any way. The contents not described herein can be readily envisioned by those skilled in the art, and thus the detailed description thereof is omitted.

1. Production of Steel Sheet Specimens

Steel slabs, which comprise the components shown in Table 1 below with the remainder being iron and impurities, were reheated at a temperature of 1180° C. for 2 hours, and then hot-rolled to obtain hot-rolled steel sheets. The hot-rolling was performed under finish rolling conditions at 900° C. corresponding to a temperature equal to or higher than the Ar3 point. Each of the hot-rolled steel sheets was cooled and coiled at 700° C.

Then, the coiled steel sheets were pickled and cold-rolled, after which the steel sheets were annealed at 820° C. for 60 seconds, and then cooled to 480° C. at a rate of 20° C./sec. The cooled steel sheets were isothermally transformed at a temperature of 480° C., after which the steel sheets were dipped in a zinc bath at 465° C. Next, the steel sheets were subjected to alloying heat treatment at 520° C., and then cooled to 300° C. corresponding to a temperature equal to or lower than the Ms point.

Next, the steel sheets were temper-rolled at a reduction ratio of 0.5% or less.

TABLE 1

(unit: wt %)

| Specimen | C | Si | Mn | P | S | Al | Cr | Mo | Nb | N (ppm) |
|---|---|---|---|---|---|---|---|---|---|---|
| #1 | 0.002 | 0.01 | 0.49 | 0.049 | 0.0060 | 0.03 | — | — | 0.01 | 27 |
| #2 | 0.018 | 0.1 | 1.52 | 0.012 | 0.0029 | 0.04 | 0.55 | — | — | 26 |
| #3 | 0.016 | 0.1 | 1.52 | 0.012 | 0.0029 | 0.38 | 0.58 | — | — | 27 |
| #4 | 0.017 | 0.1 | 1.50 | 0.012 | 0.0030 | 0.41 | 0.53 | 0.2 | — | 27 |
| #5 | 0.018 | 0.1 | 1.53 | 0.012 | 0.0029 | 0.03 | 0.5 | 0.2 | — | 27 |
| #6 | 0.012 | 0.01 | 1.52 | — | 0.0030 | 0.03 | 1.0 | — | — | 30 |
| #7 | 0.013 | 0.01 | 1.49 | — | 0.0030 | 0.50 | 1.0 | — | — | 29 |
| #8 | 0.014 | 0.01 | 1.50 | 0.050 | 0.0030 | 0.50 | 1.0 | — | — | 31 |
| #9 | 0.013 | 0.01 | 1.51 | — | 0.0030 | 0.50 | 1.0 | 0.3 | — | 30 |

Table 2 below shows the mechanical properties of specimens 1 to 9

TABLE 2

| | Mechanical properties | | | | | |
|---|---|---|---|---|---|---|
| Specimen | YP (MPa) | TS (MPa) | El (%) | YR (%) | r-bar | Remarks |
| 1 | 220 | 350 | 43.0 | 62.9 | 1.79 | Comparative Example |
| 2 | 290 | 404 | 41.3 | 71.8 | 1.01 | Comparative Example |
| 3 | 221 | 414 | 40.1 | 53.4 | 1.32 | Inventive Example |
| 4 | 230 | 409 | 39.8 | 56.2 | 1.42 | Inventive Example |
| 5 | 240 | 398 | 40.1 | 60.3 | 1.36 | Comparative Example |
| 6 | 234 | 377 | 42.3 | 62.1 | 1.11 | Comparative Example |
| 7 | 219 | 409 | 40.2 | 53.5 | 1.33 | Inventive Example |
| 8 | 235 | 404 | 40.8 | 58.2 | 1.40 | Inventive Example |
| 9 | 241 | 415 | 39.4 | 58.1 | 1.43 | Inventive Example |

As can be seen in Table 2 above, specimens 3, 4 and 7 to 9 satisfying the alloy composition specified in the present invention showed a yield ratio of less than 60% and an r-bar value of 1.2 or higher.

However, specimens 1 and 2, which contain no chromium and have a relatively low aluminum content, showed a very high yield ratio. Also, specimens 5 and 6, which satisfy other conditions but have a relatively low aluminum content, showed a yield ratio higher than 60%, and specimen 6 showed a relatively low r-bar value.

Table 3 below shows the microstructure, dislocation density and upper yield properties of specimens 1 to 5.

The microstructure and dislocation density of each specimen was measured using EBSD (Electron BackScatter Diffraction).

In addition, the dislocation density was evaluated by crystallographic misorientation analysis using EBSD (Electron BackScatter Diffraction), and calculated using the following equation:

$$KAM[\theta]=1/6n\times\Sigma(\theta_1+\theta_2+\ldots+\theta_n)$$

$$L=a(2n+1)$$

$$\rho(\theta)=2*\theta/L*|b|$$

wherein KAM[θ] is kernel average misorientation, θ is misorientation angle, L is unit Length, a is step length, n is the number of kernels, ρ(θ) is dislocation density, and b is burgers vector.

The martensite hardness was measured using a micro hardness tester.

In addition, to evaluate the upper yield properties, each of the specimens was subjected to an accelerated aging test at a temperature of 100° C. without pre-strain.

In addition, referring to Table 3 above, it can be seen that in the case of specimens 3 to 5, the increase in the dislocation density was greater as the martensite hardness was higher, indicating that the martensite hardness was greatly increased to 480 Hv or higher due to the addition of aluminum, chromium, phosphorus and molybdenum, thereby improving the aging resistance of specimens 3 to 5. However, it can be seen that in the case of specimen 5, the martensite hardness was low due to the addition of aluminum in an amount corresponding to that of impurities, and for this reason, the time point of occurrence of upper yield in specimen 5 was faster than that in specimens 3 and 4, even though the dislocation density of specimen 5 was $1\times10^{13}/m^2$ or more after SPM (temper-rolling).

In addition, steel slabs, which comprise the components shown in Table 4 below with the remainder being irons and impurities, were reheated at 1200° C. for 2 hours, and then hot-rolled. The hot rolling was performed under finish rolling conditions at 870° C. corresponding to a temperature equal to or higher than the Ar3 point to obtain hot-rolled steel sheets. The hot-rolled steel sheets were cooled, and then coiled at temperatures shown in Table 5 below.

Next, the steel sheets were pickled and cold-rolled, after which the steel sheets were annealed at 840° C. for 100 seconds. The annealed steel sheets were cooled to 300° C. at a rate of 20° C./sec corresponding to a temperature equal to or lower than the Ms point.

Then, the cooled steel sheets were temper-rolled at a reduction ratio of 0.5%.

TABLE 3

| Specimen | F grain size (μm) | M volume ratio (%) | M hardness (Hv) | Dislocation density Before SPM | Dislocation density After SPM | 100° C. accelerated aging test (time point of occurrence of upper yield) | Remarks |
|---|---|---|---|---|---|---|---|
| #1 | 16.4 | 0 | — | $5.71\times10^{12}$ | $6.13\times10^{12}$ | 30 min | Comparative Example |
| #2 | 19.0 | 0 | — | $5.92\times10^{12}$ | $6.40\times10^{12}$ | 30 min | Comparative Example |
| #3 | 18.3 | 4.8 | 490 | $3.13\times10^{13}$ | $3.98\times10^{13}$ | 21600 min | Inventive Example |
| #4 | 16.2 | 4.7 | 550 | $5.74\times10^{13}$ | $6.80\times10^{13}$ | 28800 min | Inventive Example |
| #5 | 17.5 | 4.4 | 460 | $9.63\times10^{12}$ | $1.43\times10^{13}$ | 7200 min | Comparative Example |

※ F: ferrite, M: martensite, SPM: temper rolling

Referring to Table 3 above, it can be seen that specimens 3 and 4 had high dislocation densities compared to those of specimens 1 and 2, and thus the time point of occurrence of upper yield in specimens 3 and 3 was significantly late.

TABLE 4

(unit: wt %)

| Steel type | C | Si | Mn | P | S | Al | Cr | Mo | N | Remarks |
|---|---|---|---|---|---|---|---|---|---|---|
| 1 | 0.015 | 0.03 | 1.5 | 0.01 | 0.003 | 0.5 | 1.0 | 0.3 | 0.003 | Inventive steel |
| 2 | 0.025 | 0.03 | 1.5 | 0.01 | 0.003 | 0.5 | 1.0 | 0.3 | 0.003 | Inventive steel |
| 3 | 0.035 | 0.03 | 1.5 | 0.01 | 0.003 | 0.5 | 1.0 | 0.3 | 0.003 | Comparative steel |
| 4 | 0.020 | 0.03 | 1.5 | 0.01 | 0.003 | 0.4 | 0.05 | — | 0.003 | Comparative steel |
| 5 | 0.020 | 0.03 | 1.5 | 0.01 | 0.003 | 0.03 | 1.0 | 0.3 | 0.003 | Comparative steel |

TABLE 5

| Specimen | Steel type | Coiling temp. (° C.) | Martensite fraction (vol %) | Mechanical properties YP (MPa) | TS (MPa) | El (%) | YR | r-bar | BH (MPa) |
|---|---|---|---|---|---|---|---|---|---|
| 10 | 1 | 700 | 7.09 | 214 | 426 | 40 | 50.2 | 1.56 | 49 |
| 11 | 2 | 700 | 8.45 | 229 | 457 | 38 | 50.1 | 1.41 | 48 |
| 12 | 3 | 700 | 8.80 | 238 | 474 | 37 | 59.2 | 1.36 | 52 |
| 13 | 1 | 600 | 8.01 | 208 | 450 | 36 | 46.2 | 1.19 | 53 |
| 14 | 4 | 700 | 1.62 | 309 | 394 | 38 | 78.4 | 1.44 | 42 |
| 15 | 5 | 700 | 1.34 | 320 | 399 | 41 | 80.2 | 1.46 | 43 |

As can be seen in Table 5 above, specimens 10 and 11 satisfying the conditions specified in the present invention satisfied an elongation (El) of 38% or higher, a bake hardenability (BH) of 30 MPa or higher and an r-value of 1.2 or higher.

However, specimen 12 having a relatively high carbon content showed an elongation lower than the desired value, indicating that the carbon content is preferably 0.025 wt % or higher in order to achieve an elongation of 38% or higher.

Moreover, specimen 13, which had the alloy composition satisfying the ranges specified in the present invention but was prepared at a relatively low coiling temperature, showed a low r-bar value and a somewhat low elongation, compared to specimens 10 and 11.

In addition, in the case of specimen 14 having a [Cr wt %]+0.3[Mo wt %] value lower than 0.3 and specimen 15 having an aluminum content of less than 0.2 wt %, the martensite fraction was less than 2%.

In addition, steel slabs, which comprises the components shown in Table 7 below with the remainder being iron and impurities, were reheated at 1200° C. for 2 hours, and then hot-rolled. The hot-rolling was finished at 870° C. corresponding to a temperature equal to or higher than the Ar3 point to obtain hot-rolled steel sheets. The hot-rolled steel sheets were cooled, and then coiled at the temperatures shown in Table 8 below.

Next, the steel sheets were pickled and cold-rolled, after which the steel sheets were annealed at the temperatures shown in Table 8 below for 100 seconds. The annealed steel sheets were cooled at a rate of 20° C./sec to 300° C. corresponding to a temperature equal to or lower than the Ms point.

Then, the steel sheets were temper-rolled at the reduction ratios shown in Table 8 below.

TABLE 7

(unit: wt %)

| Steel type | Specimen | C | Si | Mn | P | S | Al | Nb | Cr | Mo | N |
|---|---|---|---|---|---|---|---|---|---|---|---|
| 6 | 18 and 19 | 0.002 | 0.1 | 0.1 | 0.05 | 0.005 | 0.03 | 0.01 | — | — | 0.0015 |
| 7 | 20 and 21 | 0.010 | 0.1 | 1.2 | 0.05 | 0.005 | 0.03 | — | — | — | 0.0015 |
| 8 | 22 to 25 | 0.010 | 0.1 | 1.2 | 0.05 | 0.005 | 0.50 | — | 0.5 | — | 0.0015 |
| 9 | 26 to 31 | 0.015 | 0.1 | 1.2 | 0.01 | 0.005 | 0.50 | — | 0.5 | — | 0.0015 |
| 10 | 32 | 0.015 | 0.05 | 1.0 | 0.01 | 0.005 | 0.10 | — | — | 0.2 | 0.005 |
| 11 | 33 | 0.010 | 0.1 | 1.8 | 0.01 | 0.005 | 1.5 | — | 0.4 | 0.3 | 0.004 |

Table 6 below shows measurement results for specimens prepared from steel type 1 at varying annealing temperatures. Specimens 16 and 17 were prepared under the same conditions as those for specimen 10 except for the annealing temperature.

TABLE 6

| Specimen | Steel type | Annealing temperature (° C.) | Martensite fraction (vol %) | Mechanical properties YP (MPa) | TS (MPa) | El (%) |
|---|---|---|---|---|---|---|
| 16 | 1 | 800 | 1.11% | 299 | 409 | 41.8 |
| 17 | 1 | 820 | 4.49% | 208 | 417 | 39.2 |
| 18 | 1 | 840 | 7.09% | 214 | 426 | 40.1 |

As can be seen in Table 6 above, the martensite fraction increased as the annealing temperature increased. In addition, an annealing temperature of 810° C. or higher showed a martensite fraction of 2 vol % or more, indicating that it is more advantageous in terms of aging resistance.

However, it can be seen that specimen 16 prepared at an annealing temperature lower than 810° C. showed a low martensite fraction.

TABLE 8

| Steel type | Specimen | Coiling temperature (° C.) | Annealing temperature (° C.) | Martensite fraction (vol %) | Temper-rolling reduction ratio (%) | Remarks |
|---|---|---|---|---|---|---|
| 6 | 18 | 700 | 790 | 0 | 1% | Comparative steel |
| | 19 | | 810 | 0 | | Comparative steel |
| 7 | 20 | 700 | 790 | 0 | 0.5% | Comparative steel |
| | 21 | | 810 | 0 | | Comparative steel |
| 8 | 22 | 500 | 790 | 3.1 | | Comparative steel |
| | 23 | | 810 | 3.5 | | Comparative steel |
| | 24 | 700 | 790 | 1.4 | | Inventive steel |
| | 25 | | 810 | 1.8 | | Inventive steel |
| 9 | 26 | 500 | 790 | 4.5 | | Comparative steel |

TABLE 8-continued

| Steel type | Specimen | Coiling temperature (° C.) | Annealing temperature (° C.) | Martensite fraction (vol %) | Temper-rolling reduction ratio (%) | Remarks |
|---|---|---|---|---|---|---|
| | 27 | | 810 | 5.2 | | Comparative steel |
| | 28 | 700 | 790 | 2.7 | | Inventive steel |
| | 29 | | 810 | 3.2 | | Inventive steel |
| | 30 | | 790 | 2.7 | 1% | Inventive steel |
| | 31 | | 810 | 3.2 | | Inventive steel |
| 10 | 32 | 710 | 800 | 1.3 | 0.5% | Inventive steel |
| 11 | 33 | 685 | 800 | 3.2 | 1.5% | Inventive steel |

Table 9 below shows the results of evaluating the physical properties of the prepared specimens.

To evaluate bake hardenability (BH), each of specimens according to Comparative Examples 1 to 8 and Examples 1 to 8 was pre-strained by 2%, and then heat-treated at 160° C. for 20 minutes, and the difference between upper yield strength after heat treatment and tensile strength after 2% pre-strain for each specimen was measured.

To evaluate aging resistance, each specimen was pre-strained by 7.5%, and then heat-treated at 100° C. for 1 hour, and the difference between lower yield strength after heat treatment and yield strength after 7.5% pre-strain was measured and expressed as aging index (AI). A higher aging index (AI) indicates better aging resistance.

In addition, to evaluate yield point elongation, each specimen was isothermally heat-treated at 30° C., and the time point of occurrence of upper yield point was evaluated at intervals of 30 days for 180 days.

As can be seen in Table 9 above, the steel sheet specimens (specimens 24, 25 and 28 to 33) satisfying the alloy composition and process conditions specified in the steel sheet production method of the present invention satisfied all the desired physical properties.

It is advantageous to maximize the difference between bake hardenability (BH) and aging index (AI) in order to prevent the occurrence of aging while ensuring dent resistance. Referring to Table 9, it can be seen that, in the case of all the specimens corresponding to the steel of the present invention, the difference between bake hardenability (BH) and aging index (AI) was greater than 10 MPa.

However, in the case of steel sheet specimens 18 to 21 which do not satisfy the alloy composition specified in the present invention, the BH-AI value was smaller than 10 MPa, and the days of occurrence of upper yield were relatively short.

In addition, in the case of the steel sheet specimens 22, 23, 26 and 27 which do not satisfy the coiling temperature conditions specified in the present invention, the r-bar value was lower than 1.2, suggesting that these steel sheet specimens have poor processability.

In conclusion, according to the steel sheet production method of the present invention, an r-value higher than 1.2 can be achieved by using the process of increasing the dislocation density during phase change and temper rolling by use of a minimum amount of martensite. In addition, the r-value of the final product can be improved by limiting the carbon content and increasing the coiling temperature (CT) in the hot-rolling step to 680° C. or higher to make a hot-rolled structure having no dual phase. This can increase the applicability of the steel sheet as an exterior panel.

Although the preferred embodiments of the present invention have been described for illustrative purposes, those skilled in the art will appreciate that various modifications, additions and substitutions are possible, without departing from the scope and spirit of the invention as disclosed in the accompanying claims.

TABLE 9

| Specimen | YP (MPa) | TS (MPa) | El (%) | YR (%) | r-bar | BH (MPa) | Al (MPa) | BH − Al (MPa) | Days of occurrence of upper yield |
|---|---|---|---|---|---|---|---|---|---|
| 18 | 225 | 349 | 41 | 0.64 | 1.96 | 34 | 26 | 8 | 120 |
| 19 | 218 | 342 | 42 | 0.63 | 1.99 | 36 | 27 | 9 | 120 |
| 20 | 255 | 368 | 41 | 0.69 | 1.45 | 41 | 38 | 3 | 30 |
| 21 | 257 | 364 | 41 | 0.70 | 1.61 | 44 | 37 | 7 | 30 |
| 22 | 228 | 372 | 41 | 0.61 | 1.08 | 45 | 23 | 22 | Not occurred |
| 23 | 232 | 389 | 39 | 0.60 | 1.11 | 49 | 24 | 25 | Not occurred |
| 24 | 236 | 381 | 39 | 0.62 | 1.41 | 48 | 31 | 17 | 180 |
| 25 | 234 | 385 | 40 | 0.61 | 1.47 | 49 | 29 | 20 | 180 |
| 26 | 194 | 409 | 36 | 0.47 | 0.98 | 55 | 23 | 32 | Not occurred |
| 27 | 214 | 397 | 38 | 0.54 | 1.02 | 51 | 24 | 27 | Not occurred |
| 28 | 222 | 389 | 38 | 0.57 | 1.31 | 49 | 28 | 21 | Not occurred |
| 29 | 218 | 398 | 39 | 0.59 | 1.41 | 53 | 24 | 29 | Not occurred |
| 30 | 237 | 392 | 38 | 0.60 | 1.29 | 48 | 20 | 28 | Not occurred |
| 31 | 241 | 405 | 38 | 0.60 | 1.42 | 52 | 19 | 34 | Not occurred |
| 32 | 229 | 375 | 40 | 0.61 | 1.39 | 46 | 22 | 24 | 180 |
| 33 | 250 | 416 | 38 | 0.60 | 1.42 | 54 | 21 | 35 | Not occurred |

What is claimed is:

1. A method for producing a steel sheet, comprising the steps of:

reheating a steel slab having an alloy composition; by weight of 0.005-0.06% carbon (c), 0.2% or less silicon (Si), 1.0-2.0% manganese (Mn), 0.01% or less sulfur (S), 0.2-2.0% aluminum (Al), one or more of chromium (Cr) and molybdenum (Mo) in an amount satisfying 0.3 ≤[Cr wt %]+0.3[Mo wt %]≤2.0 wt %, and 0.008% or less nitrogen (N), with a remainder being iron (Fe) and inevitable impurities, and wherein a density of dislocations in a ferrite matrix of the steel sheet is $1\times10^{13}/m^2$ or more;

hot-rolling the reheated steel slab at a temperature equal to or higher than an Ar3 point of the steel slab to obtain a hot-rolled steel sheet;

coiling the hot-rolled steel sheet at a temperature of 680° C. or higher;

pickling the coiled steel sheet;

then cold rolling the pickled steel sheet;

annealing the cold-rolled steel sheet such that an austenite volume fraction thereof is 20 vol % or less, followed by cooling the cold rolled steel sheet; and temper-rolling the cooled steel sheet, where the cooling is performed at an average cooling rate of 15-30° C./sec.

2. The method of claim 1, wherein the annealing is performed such that the austenite volume fraction is 10-20 vol %.

3. The method of claim 1, wherein the annealing is performed at a temperature ranging from 810° C. to 850° C.

4. The method of claim 1, wherein the cooling is performed to a temperature ranging from 450° C. to 510° C.

5. The method of claim 4, further comprising the steps of:

isothermally transforming the cooled steel sheet; and cooling the isothermally transformed steel sheet to a temperature equal to or lower than an Ms point of the steel sheet, wherein the temper rolling is performed on the steel sheet cooled to the temperature equal to or lower than the Ms point.

6. The method of claim 1, wherein the cooling is performed to a temperature equal to or lower than an Ms point of the steel sheet.

7. The method of claim 1, further comprising, between the annealing and cooling step and the temper-rolling step, a step of hot-dipping the steel sheet.

8. The method of claim 1, wherein the temper rolling is performed at a reduction ratio of 0.5-2.0%.

* * * * *